US008801121B2

(12) United States Patent
Tosin

(10) Patent No.: US 8,801,121 B2
(45) Date of Patent: Aug. 12, 2014

(54) CHEST OF DRAWERS

(75) Inventor: Giuseppe Tosin, Bassano del Grappa (IT)

(73) Assignee: FAMI S.R.L., Rosa (IT)

( * ) Notice: Subject to any disclaimer, the term of this patent is extended or adjusted under 35 U.S.C. 154(b) by 258 days.

(21) Appl. No.: 13/313,795

(22) Filed: Dec. 7, 2011

(65) Prior Publication Data

US 2012/0153793 A1 Jun. 21, 2012

(30) Foreign Application Priority Data

Dec. 16, 2010 (IT) ..... MO2010A0353

(51) Int. Cl.

| | |
|---|---|
| ***A47B 88/10*** | (2006.01) |
| ***A47B 67/04*** | (2006.01) |
| ***A47B 88/14*** | (2006.01) |

(52) U.S. Cl.

CPC ..... *A47B 88/14* (2013.01); *A47B 2210/0059* (2013.01); *A47B 67/04* (2013.01); *A47B 2210/0045* (2013.01)

USPC ..... 312/334.12; 312/334.18

(58) Field of Classification Search

USPC ..... 312/330.1, 257.1, 334.1, 334.7, 334.8, 312/348.1, 348.4, 334.12, 334.18, 334.19, 312/334.39, 334.41

See application file for complete search history.

(56) References Cited

U.S. PATENT DOCUMENTS

| | | | | | |
|---|---|---|---|---|---|
| 3,701,577 | A | * | 10/1972 | Fischer | 312/334.12 |
| 3,729,246 | A | * | 4/1973 | Harrell et al. | 312/348.2 |
| 4,232,921 | A | * | 11/1980 | Peele | 312/350 |
| 5,214,836 | A | | 6/1993 | Beals | |
| 5,449,231 | A | * | 9/1995 | Lin | 312/334.18 |
| 5,456,531 | A | | 10/1995 | Beals | |
| 5,618,091 | A | * | 4/1997 | Huber et al. | 312/348.1 |

FOREIGN PATENT DOCUMENTS

DE 20 2009 000665 U1 6/2010

* cited by examiner

*Primary Examiner* — James O Hansen
(74) *Attorney, Agent, or Firm* — Pearne & Gordon LLP

(57) ABSTRACT

A chest of drawers includes a frame (2) comprising two uprights (3) facing each other, each upright having a front edge (3*c*); at least one drawer (6) associated with the uprights and having a front portion (6*f*); the drawer is also sliding with respect to the uprights between a closed configuration in which it is housed between the uprights and a pull-out configuration in which it projects with respect to the front edge of the uprights; at least one guide (9) connected to an inside surface (3*a*) of one of the uprights and comprising a sliding device (10) rotatably fastened to the upright and associated with the drawer to make it movable along the guide; the sliding device is located on said upright near the front edge; the drawer has a housing at the front portion to accommodate the sliding device when the drawer is in the closed configuration.

2 Claims, 3 Drawing Sheets

CHEST OF DRAWERS

The present invention relates to a chest of drawers, particularly a tool chest of drawers. Such tool chests of drawers find application in factories, workshops, joineries, carpentry workshops and in many more other places.

A chest of drawers of a known type comprises a frame, with which a plurality of drawers are associated.

More specifically, the frame comprises two uprights facing each other. Such uprights each have a front edge and a rear edge. Moreover, the uprights are fastened to a base and are interconnected by an upper panel.

A chest of drawers of known type is described in U.S. Pat. No. 5,214,836 that describes a filing cabinet and method for constructing a metal filing cabinet.

In particular, the drawers cited hereinabove are associated with the uprights so as to enable them to slide with respect to the latter in order to be inserted in and pulled out of the frame. Moreover, each drawer comprises a front portion, to which a handle is fastened.

The chest of drawers comprises a pair of guides for every drawer. Each guide in every pair is connected to an inside wall of a respective upright. Furthermore, each guide comprises a cylindrical bearing fastened to the respective upright. More specifically, each bearing has a rotation axis perpendicular to the upright and slides over a rail fastened to an outside sidewall of the drawer. In this manner, each drawer proves to be movable along a respective pair of guides. In greater detail, a slide is fastened in an area at the rear of the drawer. Such slide serves the function of engaging the cited guide to slide thereon, and thus that of providing the drawer with a resting point.

As a result, each drawer can travel from a closed configuration to a pull-out configuration and vice versa. More specifically, each drawer is housed between the uprights in the closed configuration, and projects with respect to the cited front edge of the uprights in the pull-out configuration. Note that the aforesaid slide abuts against the bearing when the drawer is in the pull-out configuration, so as to prevent the drawer from coming off the guides.

The drawer of the prior art has a major drawback. In fact, as it abuts against the slide as described hereinabove, the bearing does not allow for the drawer to be pulled out completely. For this reason, insertion or removal of the tools in or from the drawer proves to be complicated in the case of tools that may fit within the inside volume of the drawer, but prove to be too large to be inserted from above when the drawer is in the pull-out configuration.

In order to obviate this drawback, there are known chests of drawers with telescopic guides. Besides the characteristics of the previously described chests of drawers, they also comprise a telescopic portion of the guide that proves to be interposed between a fixed portion of the cited guide, corresponding to the simple guide described hereinabove, and the rail fastened to the drawer.

In this case, the slide fastened to the rail engages the telescopic portion of the guide. Likewise, the bearing in the fixed portion engages the telescopic portion so as to permit it to slide with respect to the fixed portion. Note that in this variant of the prior art chest of drawers, the telescopic portion comprises a further bearing associated with the drawer rail, and a further slide associated with the fixed portion of the guide.

When the drawer is pulled out, the rail slides with respect to the telescopic portion of the guide, while the latter slides with respect to the fixed portion. Note that the telescopic portion projects beyond the front edges of the uprights in the pull-out configuration of the drawer, and is retracted between the uprights in the closed configuration. In this manner, the telescopic portion extends the guide in the pull-out configuration of the drawer, and it permits it to be pulled out completely.

A disadvantage of this variant of the prior art chest of drawers lies in its considerably complex construction, which necessarily entails higher costs. In this context, the technical task underlying the present invention is to propose a chest of drawers that overcomes the aforesaid drawbacks of the prior art.

More specifically, an aim of the present invention is to make available a chest of drawers of simple construction capable of permitting easy removal and insertion of tools from/into the drawers.

The set technical task and the specified aims are substantially achieved by a chest of drawers comprising the technical characteristics stated in one or more of the appended claims.

Further characteristics and advantages of the present invention will become more apparent from the indicative, and thus non-limiting, description of a preferred, though not exclusive, embodiment of a chest of drawers, as illustrated in the appended drawings, wherein.

Figure 1:
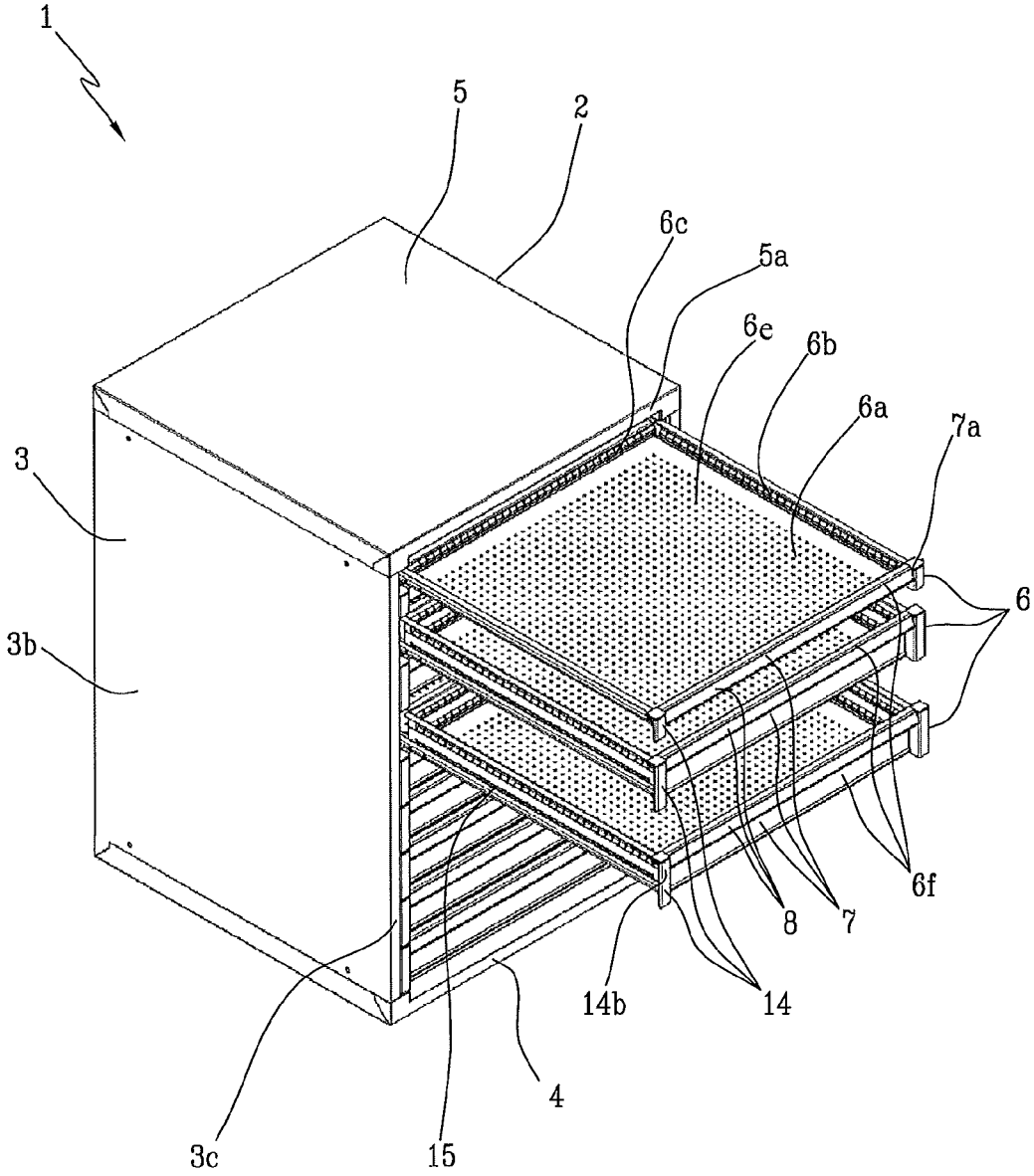
FIG. 1 is a perspective view of a chest of drawers according to the present invention.

With reference to the appended figures, 1 denotes a chest of drawers according to the present invention. More specifically, the embodiment of the chest of drawers 1 described hereinafter refers to a tool chest of drawers 1.

The chest of drawers 1 comprises a frame 2. The frame 2 comprises two uprights 3, facing each other. Furthermore, the frame 2 comprises a supporting base 4, connected to the uprights 3, and preferably an upper panel 5 that is also connected to the uprights 3 and opposite the base 4.

Each upright 3 has an inside surface 3*a* and an outside surface 3*b*. More specifically, the respective inside surfaces 3*a* of the uprights 3 face each other. Each upright 3 also has a front edge 3*c*, located between the inside surface 3*a* and the outside surface 3*b*. In particular, the front edges 3*c* lie on a plane that defines a front plane of the chest of drawers 1.

The chest of drawers 1 further comprises a drawer 6 associated with the uprights 3, so as to enable it to slide with respect to the latter, in order to be inserted into and pulled out from the chest of drawers 1. In particular, the drawer 6 has an inside compartment 6*a*. Furthermore, the drawer 6 has two inside side surfaces 6*b*, an inside rear surface 6*c*, an inside front surface 6*d* and a bottom 6*e* that define the compartment 6*a*.

Moreover, the drawer 6 has a front portion 6*f* substantially arranged in a parallel manner with respect to the cited front plane. More specifically, the drawer 6 comprises a front panel 7, preferably made of sheet metal and arranged at the front portion 6*f* of the drawer 6. In greater detail, the front panel 7 defines the inside front surface 6*d* of the drawer 6.

The drawer 6 further comprises a handle 8, connected to the front panel 7. As shown in detail in FIG. 3, the handle 8 is obtained by bending a portion of the front panel 7 of the drawer 6.

With reference to FIG. 1, the chest of drawers 1 may comprise a plurality of drawers 6. The number and dimensions of such drawers 6 may vary according to utilization needs. Each drawer 6 can be inserted and pulled out independently of the others.

As mentioned hereinabove, each drawer 6 is movable with respect to the uprights 3. In particular, each drawer 6 is switchable between a closed configuration, wherein it is housed between the uprights 3, and a pull-out configuration, wherein it projects with respect to the front edge 3*c* of the uprights 3. In other words, in the pull-out configuration, the drawer 6 projects with respect to the front plane of the chest of drawers 1. Likewise, in the closed configuration, the drawer 6 does not project with respect to the front plane. Advantageously, this makes the chest of drawers 1 safer, in that when all the drawers 6 are in the closed configuration, there are no protruding parts that can become entangled in the power cords of the workshop tools.

Figure 2:
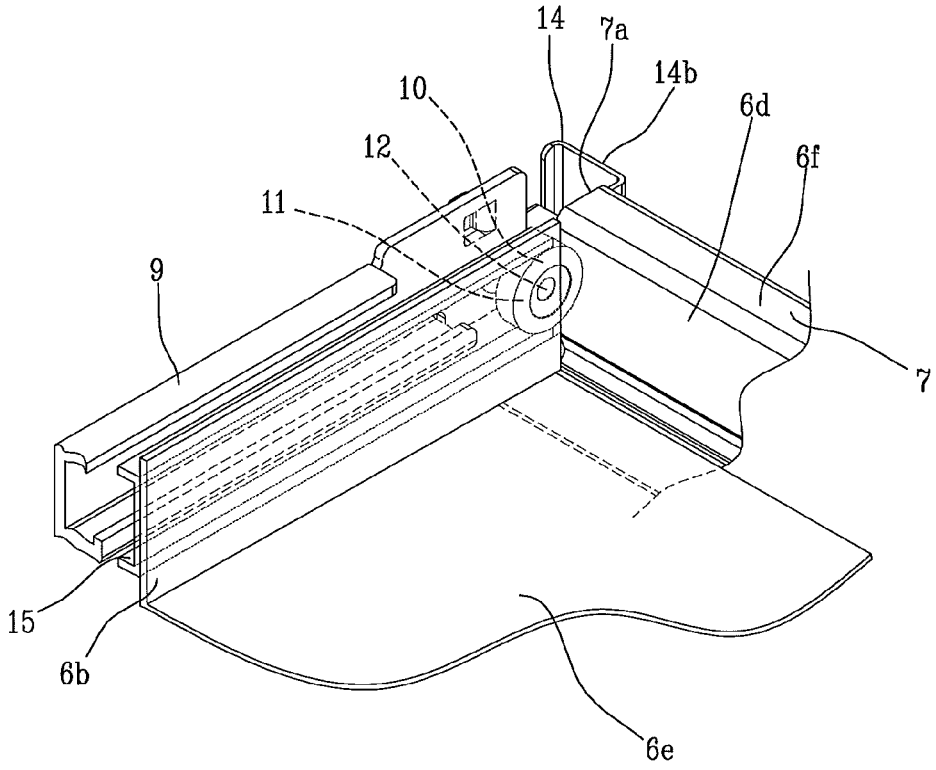
FIG. 2 is a perspective view of a detail of the chest of drawers shown in FIG. 1.

As illustrated in particular in FIG. 2, the chest of drawers 1 comprises at least one guide 9 connected to an inside surface 3*a* of one of the cited uprights 3. In the embodiment described and illustrated in the appended figures, the chest of drawers 1 comprises two guides 9 for each drawer 6. More specifically, each guide 9 is connected to its respective upright 3 preferably at the inside surface 3*a*. Furthermore, each pair of guides 9 lies on a plane perpendicular to the uprights 3 and preferably parallel to the base 4 of the chest of drawers 1. Note that for each pair of guides 9, each one is associated with an inside surface 3*a* of one of the cited drawers 6.

The drawer 6 is sliding with respect to the guides 9. More specifically, each guide 9 comprises a respective sliding device 10 associated with the drawer 6 and rotatably fastened to the guide 9, in a manner that makes the drawer movable along the cited guide 9.

Figure 3:
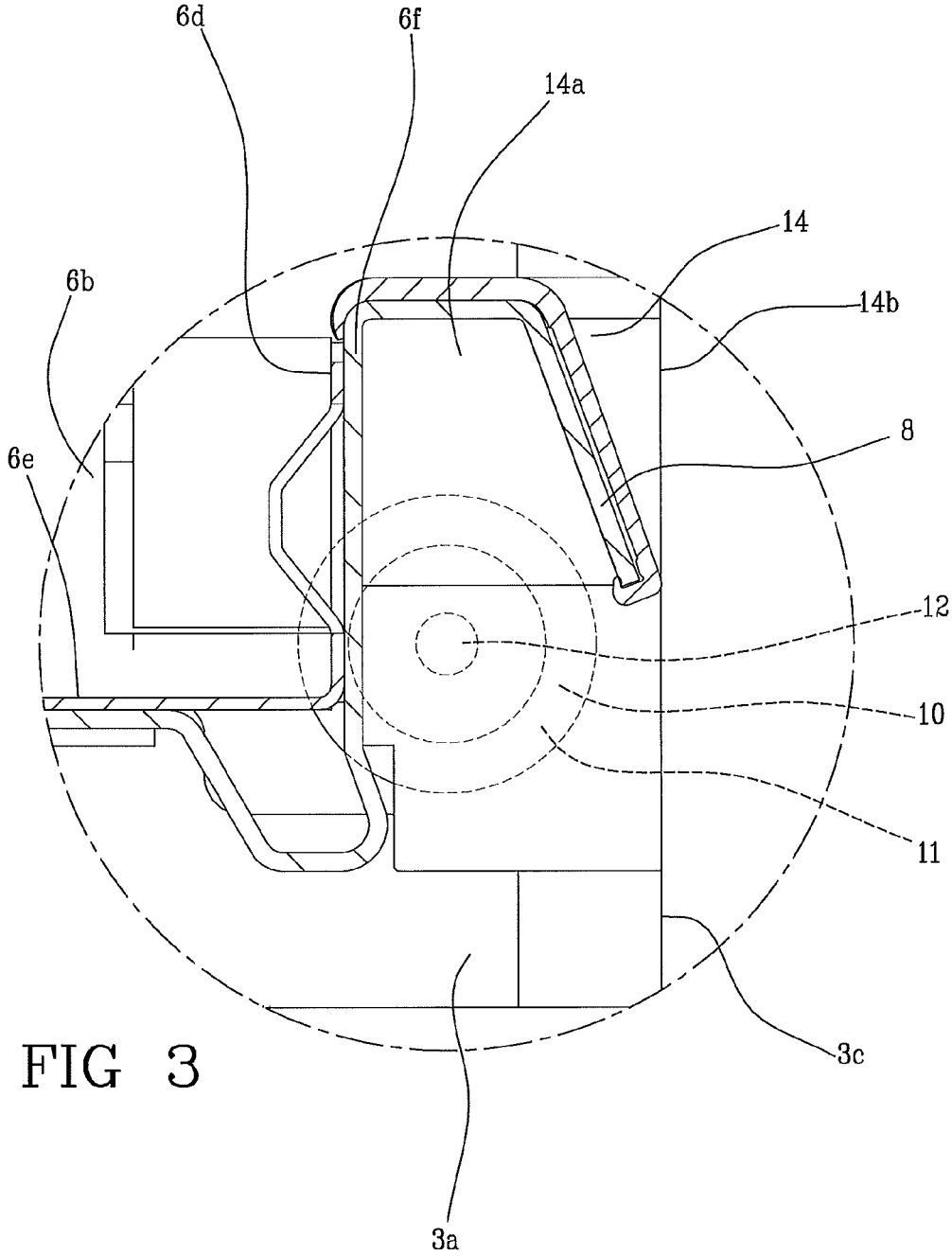
FIG. 3 is a sectional side view of a detail of the chest of drawers shown in FIG. 1.

In detail, the sliding device 10 is located on the guide 9 near the front edge 3*c*. In the described embodiment, the sliding device 10 is a ball bearing 11. More specifically, the bearing 11 has a rotation axis perpendicular to the uprights 3. As can be seen in FIG. 3, the bearing 11 is connected to a pin 12 fastened to the guide 9.

According to the present invention, the drawer 6 has a housing 14 at a front portion 6*f* thereof. Such housing 14 serves the function of housing the sliding device 10 when the drawer 6 is in the cited closed configuration.

In particular, the drawer 6 has a pair of housings 14, in order that each of them can accommodate a corresponding sliding device 10 associated with a respective guide 9.

In particular, each housing 14 is positioned on a side edge 7*a* of the front panel 7. In other words, the housings 14 are located on opposite sides of the drawer 6.

In greater detail, each housing 14 has a sidewall 14*a* parallel to the uprights 3. Moreover, the sidewall 14*a* of each housing 14 faces the front panel 7 of the drawer 6.

Likewise, the housing 14 has a front wall 14*b* arranged transversally and preferably perpendicular to the uprights 3, and substantially parallel to the front panel 7 of the drawer 6. Note that such front wall 14*b* proves to be projecting with respect to the cited front panel 7 of the drawer 6.

Advantageously, the front wall 14*b* of the housing 14 is substantially coplanar to the front edges 3*c* of the uprights 3 when the drawer 6 is in the closed configuration. In other words, in the closed configuration, the front wall 14*b* of the housing 14 lies substantially on the front plane of the chest of drawers 1. In this manner, the front walls 14*b* do not project outward, and they lower the chances of something becoming entangled in the chest of drawers 1 when the drawers 6 are closed. Note also that for this same reason, the handle 8 cited previously does not project with respect to the front wall 14*b* of the housing 14. In other words, the front wall 14*b* of the housing 14 does not project with respect to the handle 8.

The chest of drawers 1 further comprises a rail 15 fastened to the drawer 6. More specifically, the chest of drawers 1 comprises a pair of rails 15, each one being fastened to a respective outside sidewall of the drawer 6.

In the described embodiment, each rail 15 engages a respective sliding device 10, in such a manner that the rail 15 can slide over the sliding device 10 and permit movement of the drawer 6. Note that the rail 15 proves to be partially fitted in the cited housing 14. Advantageously, this permits insertion of the sliding device 10 in the housing 14.

In greater detail, a slide (not illustrated) is fastened to each rail 15 and by engaging a respective guide 9, it facilitates the sliding of the drawer 6 with respect to the guide. In the embodiment described and illustrated, the slide has a structure that is substantially similar to the bearing 11 in the guide 9.

Note also that the aforesaid slide abuts against the bearing 11 when the drawer 6 is in the pull-out configuration, so as to prevent the drawer 6 from coming off the guides 9.

According to an unillustrated embodiment of the present invention, the guide 9 comprises a fixed portion and a telescopic portion.

In this case, the slide fastened to the rail 15 engages the telescopic portion of the guide 9. Likewise, the sliding device 10 in the fixed portion engages the telescopic portion so as to permit it to slide with respect to the fixed portion. Note that in this embodiment, the telescopic portion comprises an additional bearing associated with the rail 15 of the drawer 6, and an additional slide associated with the fixed portion of the guide 9.

When the drawer 6 is pulled out, the rail 15 slides with respect to the telescopic portion of the guide 9, while the latter slides with respect to the fixed portion. Note that the telescopic portion projects beyond the front edges 3*c* of the uprights 3 in the pull-out configuration of the drawer 6, and is retracted between the uprights 3 in the closed configuration. In this manner, the telescopic portion extends the guide 9 in the pull-out configuration of the drawer 6.

Lastly, note that all parts of the drawer 1 are made of bent sheet metal. Advantageously, industrial production of the chest of drawers proves to be easy and economical.

To prevent sharp sheet-metal edges from injuring the user, the upper panel 5 has an edge 5*a* that is bent inwards.

The invention achieves the proposed aim. In particular, the presence of the housing allows for positioning of the sliding devices near the front edges of the uprights. This makes it possible to pull out the drawer completely, without having to employ telescopic guides, and thus keeping the structure of the chest of drawers extremely simple.

The invention claimed is:

1. A chest of drawers (1), comprising a frame (2) comprising two uprights (3) facing each other, each upright (3) having a front edge (3*c*); at least one drawer (6) associated with said uprights (3) and having a front portion (6*f*), said drawer (6) also being sliding with respect to said uprights (3) between a closed configuration in which it is housed between said uprights (3) and a pull-out configuration in which it projects with respect to said front edge (3*c*) of said uprights (3); at least one guide (9) connected to an inside surface (3*a*) of one of said uprights (3) and comprising a sliding device (10) rotatably fastened to said guide (9) and associated with said drawer (6) to make it movable along said guide (9);

said sliding device (10) being located on said guide (9) near said front edge (3*c*), at least a portion of the sliding device (10) protruding beyond a forward edge of the guide (9), said drawer (6) having a housing (14) at said front portion (6*f*) to accommodate said sliding device (10) when said drawer (6) is in the closed configuration and comprising a front panel (7), said housing (14) being positioned at a side edge (7*a*) of said front panel (7);

a rail (15) being fastened to said drawer (6), resulting partially fitted in said housing (14) and engaging said sliding device (10) to slide over it and permit movement of the drawer (6);

said housing (14) having a front wall (14*b*) substantially transverse to said uprights (3) and projecting with respect to said front panel (7) of said drawer (6), the protruding portion of the sliding device (10) being housed within the front wall (14*b*) of the housing (14);

characterized in that said front wall (14*b*) of said housing (14) is substantially coplanar to said front edges (3*c*) of said uprights (3) when said drawer (6) is in the closed configuration.

2. The chest of drawers according to claim 1, characterized in that said drawer (6) comprises a handle (8); said front wall (14*b*) of said housing (14) not projecting with respect to said handle (8).

* * * * *